United States Patent [19]

Chauffe

[11] 4,337,653

[45] Jul. 6, 1982

[54] BLOWOUT PREVENTER CONTROL AND RECORDER SYSTEM

[75] Inventor: John A. Chauffe, Houston, Tex.

[73] Assignee: Koomey, Inc., Houston, Tex.

[21] Appl. No.: 258,510

[22] Filed: Apr. 29, 1981

[51] Int. Cl.[3] ..... E21B 47/00; E03B 7/07; E21B 44/00

[52] U.S. Cl. ..... 73/151; 166/53; 166/250; 137/554; 340/854; 175/25

[58] Field of Search ..... 73/151; 166/53, 250; 137/554; 364/422; 346/33 WL; 340/870.13, 870.14, 853, 854; 367/70; 251/1 R; 175/25

[56] References Cited

U.S. PATENT DOCUMENTS

| | | | |
|---|---|---|---|
| 2,883,255 | 4/1959 | Anderson | 340/870.13 X |
| 3,219,107 | 11/1965 | Brown, Jr. et al. | 166/53 X |
| 3,443,643 | 5/1969 | Jones et al. | 175/25 |
| 3,470,971 | 10/1969 | Dower | 175/25 |
| 3,477,526 | 11/1969 | Jones et al. | 175/25 |
| 3,478,318 | 11/1969 | Rorholt | 340/870.13 X |
| 3,552,502 | 1/1971 | Wilson | 175/25 |
| 3,786,423 | 1/1974 | Martell | 340/870.13 X |
| 4,018,276 | 4/1977 | Bode | 166/250 X |
| 4,030,354 | 6/1977 | Scott | 73/151 |
| 4,038,632 | 7/1977 | Parker | 340/854 X |
| 4,095,421 | 6/1978 | Silcox | 251/1 R X |
| 4,115,753 | 9/1978 | Shajewko | 340/854 X |
| 4,245,313 | 1/1981 | Coates | 364/422 |
| 4,253,530 | 3/1981 | Sharki et al. | 175/25 |
| 4,273,212 | 6/1981 | Dorr et al. | 73/151 X |
| 4,319,634 | 3/1982 | McMahon et al. | 166/250 |

FOREIGN PATENT DOCUMENTS

| | | | |
|---|---|---|---|
| 7811304 | 5/1979 | Netherlands | 73/151 |

OTHER PUBLICATIONS

"Well Kicks Automatically Controlled," by Jones et al. from 23rd Annual ASME Petroleum Mech. Eng. Conf., Sep. 1968, Dallas, Texas.

"New Well-Control Unit Speeds Safer Handling of Blowouts" by Records et al., In Oil and Gas Journal, Sep. 10, 1962.

Platform Safety by Downhole Control, by Raulins, at 46th annual Fall Met. of Society of Petroleum Eng. of AIME at New Orleans, La., Oct. 1971.

pp. 82–86 of the 1980–81 General Catalog of Koomey, Inc.

*Primary Examiner*—Stuart S. Levy
*Assistant Examiner*—David V. Carlson
*Attorney, Agent, or Firm*—Fulbright & Jaworski

[57] ABSTRACT

A control and recorder system for a blowout preventer for providing a record of operation and status of the various components of the blowout control system at periodic times and after a function operation. The system monitors various functions such as whether the accumulator pump is running, the open and close status of the various rams, bypass, annular, flow line, kill line and choke line as well as various pressures, such as in the annular, the accumulator and the manifold, flow measurements of various fluids in the system and provides alarms for various parameter values. Control and status information may be transmitted through fiber optic cables between various control stations at the rig floor, accumulators and remote locations for avoiding interference by electrical noises or radio frequencies and providing a safety link through hazardous gas areas.

7 Claims, 12 Drawing Figures

18
20

24
22
16
12
10
14

DISABLE INTERRUPTS
300
SELF TEST
301
INITIALIZE S 10 & PORTS
302
INITIALIZE CTC
303
INITIALIZE CLK 00:00:00
304
INITIALIZE INTERVAL "0"
305
INITIALIZE A/D
306
INITIALIZE FLOW "ON&OFF"
307
SCAN STORE INITIAL DATA
308
CHK CTC
309
310
CHANGE
Y
N
CENTRAL
INT "1"
STORE PB CHANGE
377
EXIT
INT "2"
SCAN ALL DATA
378
TX-PRINTER DATA
379
EXIT

BLOWOUT PREVENTER CONTROL AND RECORDER SYSTEM

BACKGROUND OF THE INVENTION

It is old to provide a blowout preventer control system as indicated at pages 82–86 of the 1980–81 General Catalog of Koomey, Inc. in which accumulators provide hydraulic fluid for actuating various blowout preventer functions such as the pipe rams, flow line, kill line, choke line and annular BOP. The various control functions are controlled by hydraulic valves which in turn are controlled by suitable electric, air or hydraulic valves. And while various position and status measurements are observable, they are of a transitory nature which only provide an indication of the status or operation of the blowout control system at the current time.

The present system provides a tangible record showing every event or change in the blowout control system and when it occurred. This is especially important should an accident or emergency condition occur. A drilling operator will be able to use the records to evaluate past actions taken by the personnel and plan where action should be taken during an emergency. Furthermore, the record can be used for training less experienced operators.

Furthermore, electrical control and information gathering lines are undesirable when utilized in the hazardous environment of an oil and/or gas drilling rig since electrical sparks which might occur if the cable is damaged might ignite hazardous gases. Electrical control and information lines are also adversely affected by electrical noises or radio frequency interference. Another feature of the present invention is the use of fiber optics for transmitting the signals required in the control system to eliminate these problems.

SUMMARY

The present invention is directed to a combination with a blowout preventer control system for controlling the opening and closing various functions and measuring the status of various conditions in the system and includes position measuring means for measuring the positions of various control functions and operating data gathering means connected to the system measuring various operating conditions. A recorder is connected to the control and position measuring means and the operating data gathering means for periodically recording the positions of the control functions and the operating conditions of the system.

In particular, the present invention is directed to measuring the positions of the various pipe rams, flow line, kill line, choke line, an annular BOP and whether the accumulator pump is on or off as well as various operating data such as the pressure in the accumulator, manifold and annular and rate and volume of fluid used by the system to operate the various functions.

Still a further object of the present invention is the provision of a plurality of control stations such as at the rig floor, the accumulators, or one or more remote locations in which a fiber optic cable is connected between the control stations for transmitting the control signals and data acquisition signals.

Yet a still further object of the present invention is the provision wherein the recorder provides a tangible record of the operation and status of the blowout preventer control system along with the date and time at periodic intervals and each time the control system is actuated.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
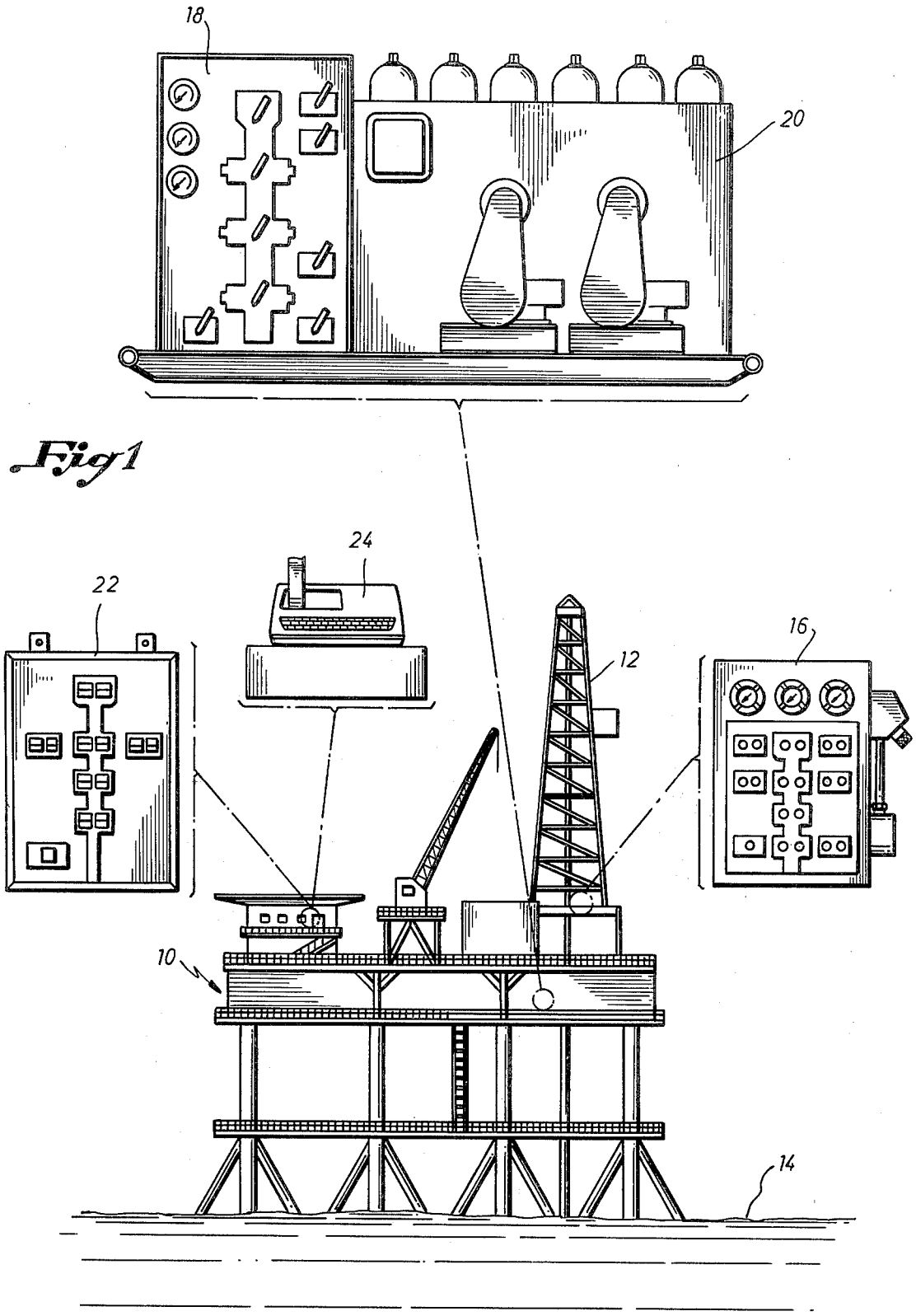
FIG. 1 is a schematic exploded elevational view illustrating an offshore drilling rig illustrating the various control stations for controlling a blowout preventer system.

Referring now to FIG. 1, the reference numeral 10 generally indicates an offshore drilling platform having a conventional drilling rig 12 over the water 14 for drilling a conventional well in which a conventional blowout preventer system (not shown) is positioned above water. The control system of the present invention includes various control and indicating panels for controlling the blowout preventers such as a driller's panel 16 located on the rig drilling floor, a panel 18 positioned with the accumulator/pump unit 20 which is located on the cellar deck and a remote panel 22 and recorder 24 located in the tool pusher's office. It is noted that panels 16 and 18 are located in hazardous areas, that is, areas exposed to an environment which may include explosive gases.

Figure 2:
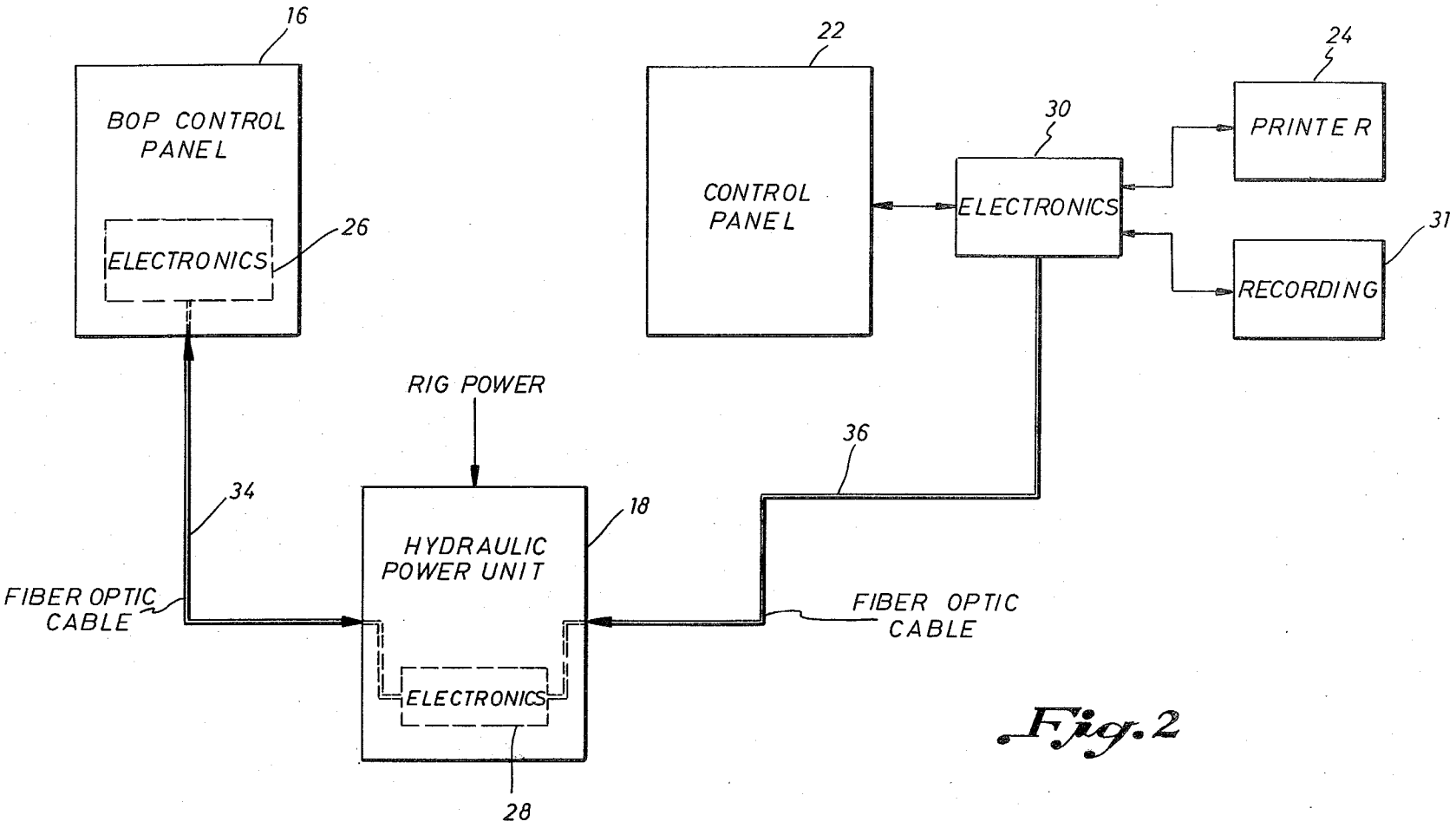
FIG. 2 is a schematic block diagram illustrating the interconnection of the control stations of FIG. 1.

Referring now to FIG. 2, each of the control and indicating panels includes an electronic section for sending and receiving electrical control and status information. Thus the driller's panel 16 includes an electronic section 26, the accumulator unit panel 18 includes an electronic section 28 and the tool pusher's remote panel 22 includes an electronic section 30 connected to the printer recorder 24 or to other types of recorders such as a magnetic tape 32. In particular, it is to be noted that the various electronic sections 26, 28 and 30 are interconnected by fiber optic cables 34 and 36, although electrical lines may be used if desired. The fiber optic cables have the advantage of being unaffected by electrical noise or radio frequency interference which may be present on the platform 10 and most important provide a safe link between the driller's panel 16 and the accumulator panel 18 since no sparks which might ignite the hazardous gases will be produced if the fiber optic cable is damaged or severed.

Figure 3:
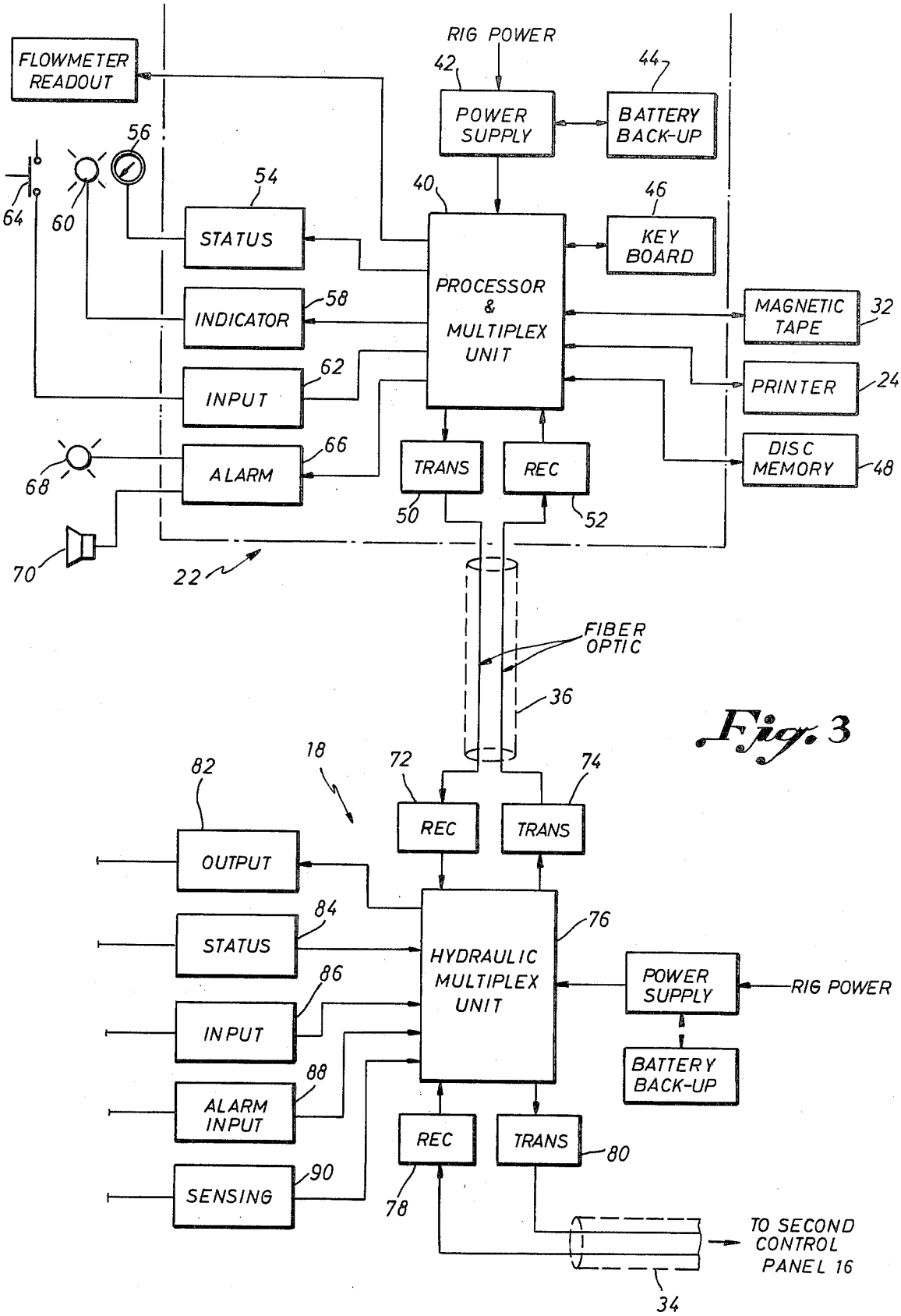
FIG. 3 is a block diagram in greater detail of two of the control stations of FIG. 1, FIGS. 4A and 4B are continuations of each other and are a schematic illustrating a typical input and output of the controls, position indicators, and information gathering means of the present invention.

Referring now to FIG. 3 the control and recording system of the present invention is shown. The remote control panel 22 generally includes a processor and multiplex unit 40 which may be supplied by power from a power supply 42 from the rig power or from a battery backup 44. A keyboard 46 is provided for required data entry into the processor 40 during startup and for manually actuating the processor 40 for updating information. Suitable recording means such as a printer 24, magnetic tape 32 or disc storage 48 may be provided for providing a record of the operation and status of the control system. A transmitter 50 and receiver 52 are provided for transmitting and receiving signals to and from the fiber optic cable 36. Various drive circuits are provided connected to the processor and multiplex unit 40 such as an analog drive circuit 54 providing a status to various instruments such as a pressure gauge 56. Indicator drive circuits 58 indicates the position of various of the functions controlled such as the annular BOP, the pipe rams, the choke and kill lines to provide a visual indication such as a light 60 indicating the position of the function. Input drive circuits 62 are connected to various switches such as switch 64 for actuating one of the functions. Alarm drive circuits 66 may be connected to a visual alarm 68 or an audible alarm 70 to indicate a problem such as low or high pressure or failure of a function to properly actuate.

Referring still to FIG. 3, the hydraulic accumulator panel 18 is illustrated with its electronics section 28 which includes a receiver 72 and transmitter 74 connected to the hydraulic accumulator processor and multiplex unit 76. An additional receiver 78 and transmitter 80 are provided connected to fiber optic cable 34 leading to the driller's control panel 16 which may have a similar schematic to the panel 22. Connected to the multiplex unit 76 are a plurality of circuits such as an output circuit 82, a status input circuit 84 for connection to various switches, an analog input circuit 86 for connection to analog inputs such as pressure transducers, an alarm input circuit 88, and a sensing circuit such as a flow detection circuit 90, for measuring fluid flow.

Figure 4A:
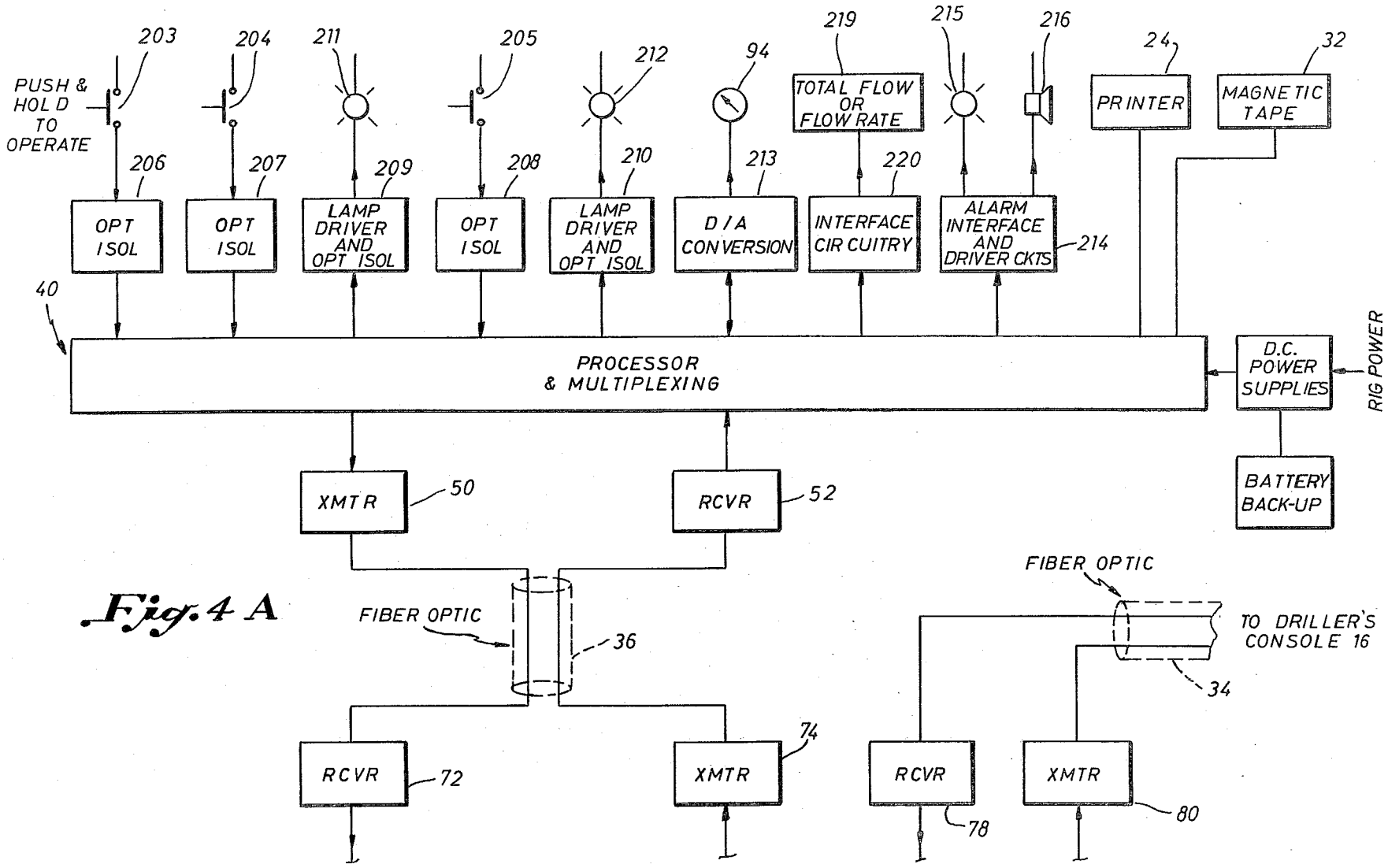
Figure 4B:
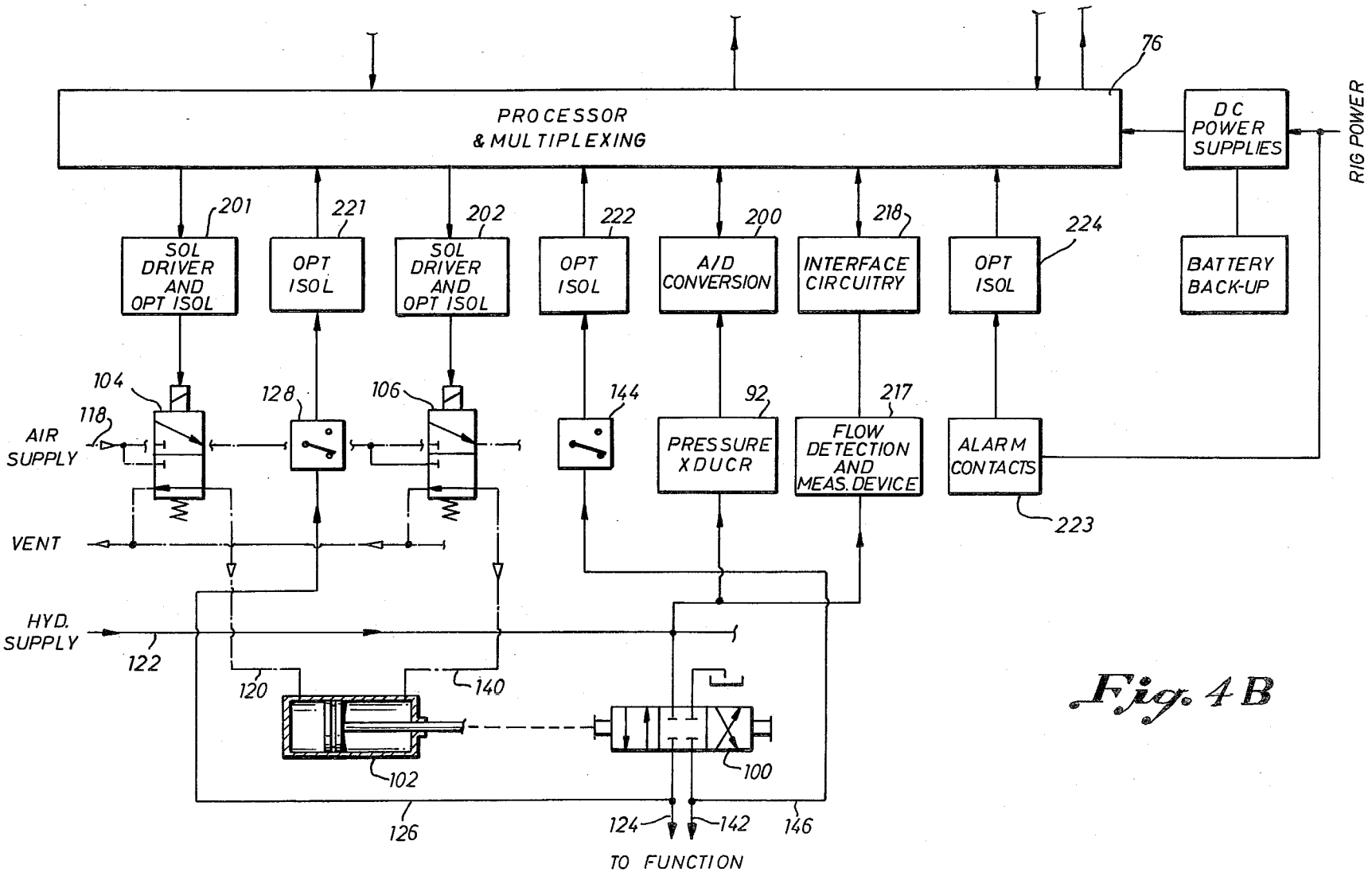

Referring now to FIGS. 4A and 4B, a single hydraulic control valve 100 (FIG. 4B) is shown for controlling one of the various functions of the blowout preventer. However, a plurality of such valves are provided for controlling, as is conventional, the various functions such as the annular blowout preventer, the various pipe rams, the flow line, the kill line, the choke line and the bypass. The hydraulic control valve 100 is conventionally actuated in blowout preventer control circuits by hydraulics, air, electricity or manually. In the present embodiment, the valve 100 is controlled by an air piston and cylinder 102 which in turn is controlled by electric solenoid valves 104 and 106.

An alternative to this is the use of a hydraulic piston and cylinder in place of the air piston and cylinder 102 and the use of suitably rated solenoid operated hydraulic valves in place of solenoid valves 104 and 106.

In either case function operation, which is a change of position of valve 100, occurs as a result of an operator action, pressing a pushbutton at one of the control panels 22 or 16 or manually shifting valve 100.

The present discussion is directed to control panel 22 with similar structure and operation from control panel 16. When the operator desires to change the function state this event will be initiated by a closure of the master switch 203 and a single function switch 204 (FIG. 4A). Function operation will not be initiated if both switches are not closed. The switches 203 and 204 are isolated from the processor and multiplexing unit 40 by optical isolator circuits 206 and 207. The output of the optical isolators 206 and 207 provide signals to the processor and multiplexing unit 40 which are processed and formatted into a message which is then transmitted to the processor and multiplexing unit 76 via the transmitter 50, fiber optic cable 36 and receiver 72.

When received, the processor and multiplexing unit 40 verifies and stores the message as well as formulating and transmitting an echo back to the control panel 22 via the transmitter 74, fiber optic cable 36 and receiver 52.

The processor and multiplexing unit 40 compares the echo message against the original command to verify the accuracy of the message. If the echo is valid an execute message is formatted and transmitted to the processor and multiplexing unit 76. If the echo is not valid the processor 40 will continue formatting and transmitting a command message and each time will verify the echo. This sequence will occur for three tries and if the function has not been properly executed, the function attempt will be discontinued and an alarm message will be outputted from the processor 40 to the recorder such as printer 24 and tape storage 32.

When the echo is valid an execute command is formatted by the processor 40 and transmitted to the processor and multiplexing unit 76. The receipt of a valid execute message causes a signal to be sent to the solenoid driver and optical isolation circuit 201. The output of this circuit energizes electrical solenoid 104. The communications between the control panel 22 and the electronics package 28 at the hydraulic power unit 18 will continue to keep the solenoid 104 energized for as long as the operator continues to press both the master switch 203 and the function switch 204.

Along with providing the execute signal to the solenoid driver circuit 201, the processor 76 formats a message which is transmitted to the processor 40 which is then re-formatted and sent to the printer 24 and magnetic tape unit 32 along with the time of activation. This sequence will occur regardless of which control panel the function operation is initiated from.

When the solenoid valve 104 is operated, an air signal from the air supply 118 is transmitted via line 120 to one side of the air piston and cylinder 102 to move the hydraulic control valve 100 to the right. This causes fluid in the hydraulic supply line 122 to be supplied to line 124 which is connected to the function and also to line 126 which is connected to pressure switch 128. Sufficient pressure in line 128 and switch 126 causes pressure switch 128 actuation providing the necessary indication of function operation.

The actuation of the pressure switch 128 provides a signal through optical isolators 221 to the processor and multiplexing unit 76. An appropriate message is formatted and transmitted simultaneously to each of the control panels 22 and 16 where the processor and multiplexing unit 40 processes the message into lamp driver 209 and signals and data which are sent to the printer 24 and magnetic tape unit 32 along with the time of activation and the elapsed time since the solenoid 104 was actiated.

The lamp driver signals drive the lamp driver and optical isolation circuits 209 causing the lamp 211 to illuminate providing the operator with a visual indication of function operation. The lamp 211 will remain illuminated until hydraulic pressure is removed from pressure switch 128.

Similarly the hydraulic control valve 100 can be moved to the opposite position by the operator pressing the master switch 203 and function button 205 which cause events similar to the above to occur activating; however, solenoid valve 106 directs air from the air supply line 118 to the opposite side of the piston and cylinder 102 through line 140 which moves hydraulic control valve 100 to the opposite position. This causes line 124 and 126 to vent and line 142 and 146 to receive hydraulic pressure from line 122. Venting line 126 causes the pressure switch 128 to return to its deenergized state which causes, through the operation of the electronics, the lamp 211 to extinguish. Pressuring line 126 activates pressure switch 144 which in turn causes, through operation similar to above, lamp 212 to illuminate, and an activated message to be printed at the printer 24 and/or stored on magnetic tape.

Again referring to FIG. 4, a pressure transducer 92 is shown. This transducer may be any of several types such as potentiometric, LVDT, or strain gauge and the output may be a voltage or current which is proportional to the input pressure. Additionally, if the transducer 92 is measuring pressure it may be of the absolute, gauge, or differential types. While a single pressure transducer 92 is shown for convenience, a plurality of pressure transducers may be provided connected individually to the pressure in the accumulators, the pressure in the blowout preventer manifold, the pressure in the annular blowout preventer, or other desired locations. By way of example only, the pressure transducer is shown connected to hydraulic line 122 for measuring the pressure of the hydraulic supply line. The output signal from the transducer 92 is in the input to the analog to digital (A/D) conversion circuit 200. The conversion from an analog to digital signal is controlled by the processor and multiplexing unit which also formats and controls the transmission of this information to the control panels 16 and 22. At the control panel 22, and similarly at control panel 16, the digital information is received by the fiber optic link 36 at the receiver 52 and is converted back to an electrical signal. The electrical signals go to the processor 40 and further to the digital to analog (D/A) conversion circuit 213 where it is converted to a voltage or current to operate the meter 94 providing a visual indication of the magnitude of the input to the transducer 92. Although an analog type meter is shown for convenience a digital display type meter may also be used in this application. In addition to a visual indication on a meter the processor 40 uses the received digital information for printing the pressures at the printer 24 and storage on magnetic tape 32.

The processor 40 also may be programmed with upper and lower values between which is specified the acceptable range for the measurement being made. When the measurement is outside the acceptable range the processor can cause an alarm circuit 214 to be activated, providing a visual 215 and/or audible 216 alarm to be activated and a printed message to be printed at the printer 24 or stored on magnetic tape 32.

A single flow detection and measuring device 217 also on FIG. 4B although more than one device may be used. This device may be any of several types that may be used to detect the movement or measure the flow of liquids or gases. By way of example only, the device 217 is shown measuring the fluid flow in hydraulic supply line 122. The output of this device 217 provides the input to the interface circuitry 218 which then goes to the processor 76. The processor 76 uses the information to determine the presence or absence of flow, the total volume of flow and/or the flow rate. This information, once computed, is then transmitted via fiber optic links 36 and 34 to each of the control panels. The processors at the control panels use the received information to provide a visual indication 219 after going through interface circuitry 220. Additionally, this information is transmitted to the printer 24 and magnetic tape 32. The processor 40 may be programmed for what is considered an acceptable value of flow, flow rate or total flow and can provide visual 215, audible 216, printed 24 or stored 32 indications when these limits are exceeded.

Also provided, and shown singularly for convenience, are alarm contacts 223 that provide acceptable or unacceptable status to the processor 76 through optical isolation circuit 224. The alarms may include, but are not limited to such states as low hydraulic pressure, low fluid level, low air pressure, rig power failure, low glycol level. By way of example, the alarm contacts 223 are shown connected to and monitoring the rig power. The alarm contacts may be normally open or normally closed. Reversal of the contacts 223 results in a signal being sent from the processor 76 simultaneously to processors in the control panels 16 and 22. At the control panel the signal is converted into a visual 215 and audible 216 alarm and at panel 22 a message will be sent to the printer 24 and tape storage 32.

The Control Unit 40—FIGS. 5A, 5B, 5C and 5D

Figure 5A:
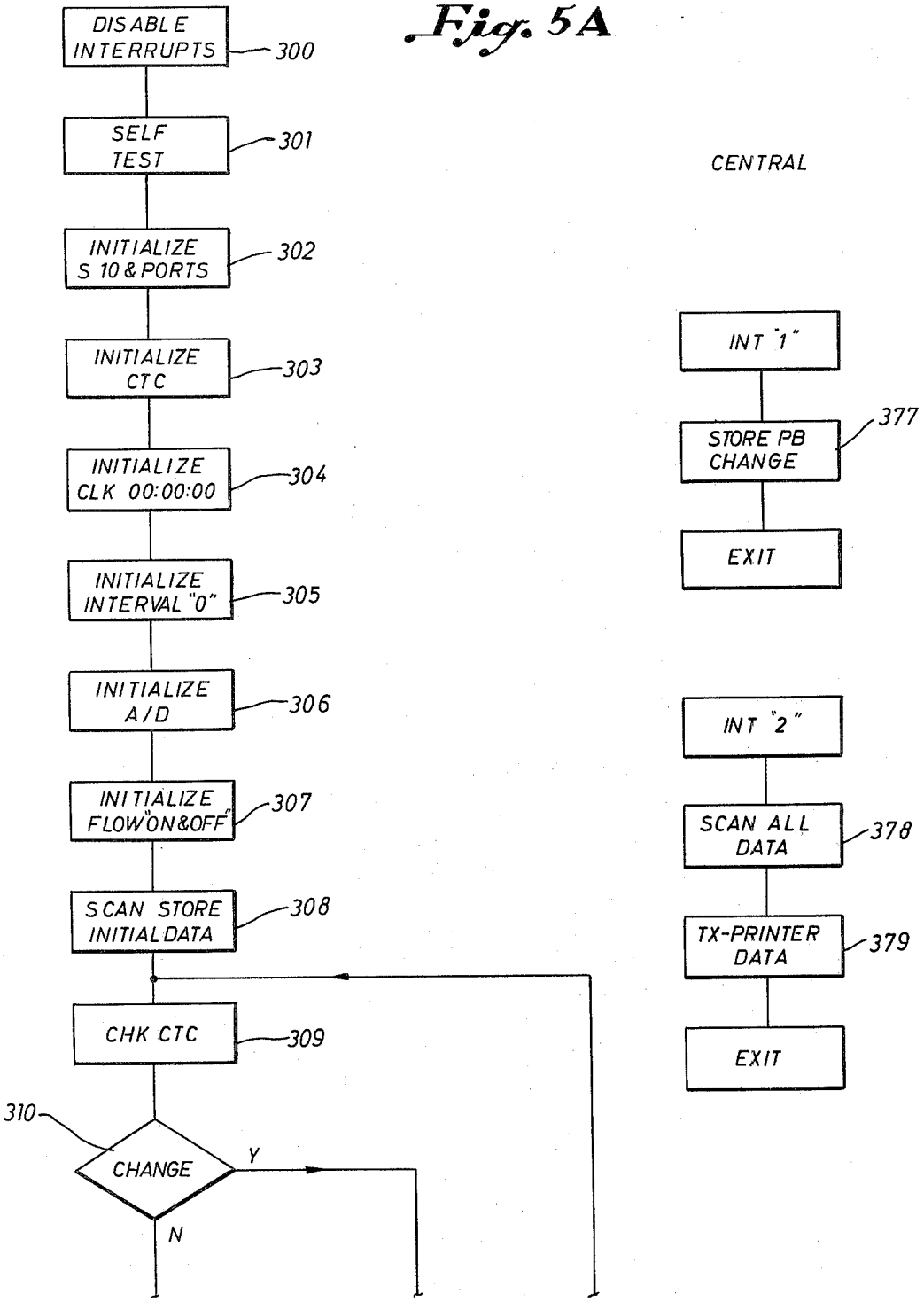
FIGS. 5A, 5B, 5C and 5D are continuations of each other and are a logic flow diagram of the central control unit.
Figure 5B:
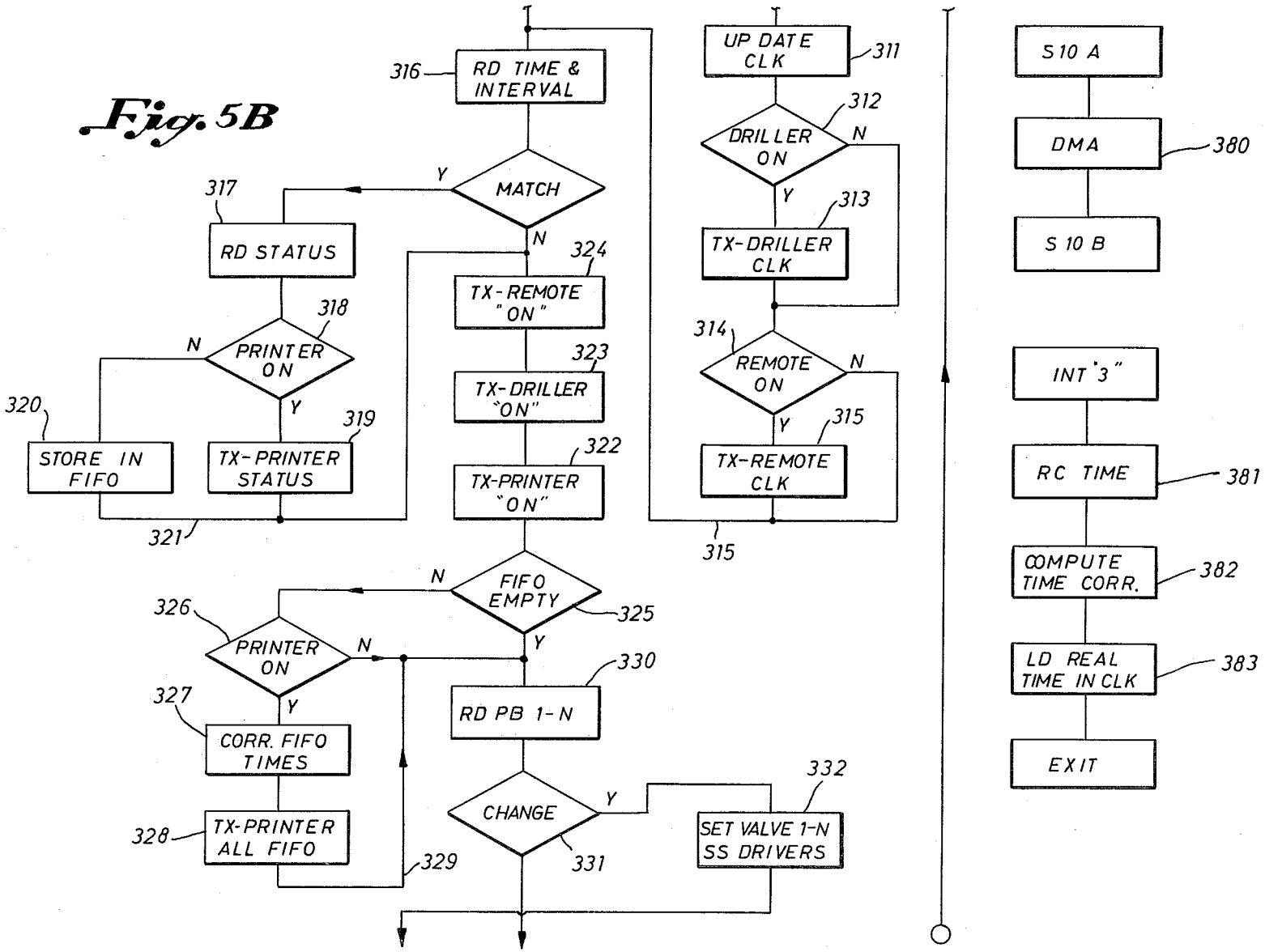

This unit provides and maintains signals to all values and monitors the status of all pressure switches (PA) and the analog values of the pressure transducers. It sends and receives communiations from both the remote 22 and driller 16 panels as well as the printer 24 and maintains the system clock. This is accomplished by a loop scanning technique which is subject to interrupts from its satellites. A typical startup and operation sequence as best seen in FIG. 5A would be as follows:

300 Disable Interrupts—this clears the interrupt structure preparatory to suitable initialization.

301 Self test—execute a CPU self-test routine to check for proper operation.

302 Initialize serial input/outputs (S10) and Ports—set up all SIO cards for the proper interrupt structure and priority. Set up the digital in port and out ports as well as the analog A/D ports. Leads "blocked" in all valves outputs.

303 Initialize computer timer circuit (CTC)—set the interrupts and load the mode and time constants to establish a real time beat.

304 Initialize system seal time clock to 00:00:00.

305 Initialize Interval—this sets all "command" times to zero.

306 Initialize A/D—loads in scaling factors and oscillations dead band values.

307 Initialize Flow "on and off"—loads in initial values to indicate flow on and flow off.

308 Scan and store initial data—reads the condition of all PS and analog values and stores them in memory.

At this time the system is ready to enter the scan loop. It will remain in the loop unless interrupted for input or output of data or self-initiated output of time, on status, interval reports, event or analog change. After interrupt it returns to the loop. A cycle through the loop is as follows.

309 CHK CTC—check the CTC for a base time beat status change.

310 If no change proceed on. If status has changed as best seen in FIG. **5*b***

311 Update CCK—advance the system clock one unit.

312 Check to see if driller 313 is on. If on, send one unit update to its slave clock. If not store in FIFO and bypass.

314 Check to see if remote is on. If on, send one unit update to its slave clock 315. If not, store in FIFO and bypass.

315 Return to loop.

316 Read time and interval. If no match proceed on. If match,

317 Read status report

318 If printer is on, send to printer 319

320 If printer is off, store in FIFO

321 Return to loop

322 Send printer "on" signal

323 Send driller "on" signal

324 Send remote "on" signal

325 Check to see if FIFO is empty. If yes, proceed on with loop. If no,

326 Check to see if printer is on. If not, proceed on with loop

327 If printer is on, correct all FIFO times if data was stored prior to clock true set.

328 Send printer, driller and remote all FIFO data as required. Clear FIFO only if all transmissions are successful.

329 Return to loop

330 Read PB1-N most current status from memory. After each event reading check to see if any change 331 has occurred since last loop. If none, proceed on with loop. If a change has occurred, 332 Set proper valve driver single shot in output ports Store new status in ref. memory.

Proceed with "change" sequence. This is explained in 340 below.

Figure 5C:
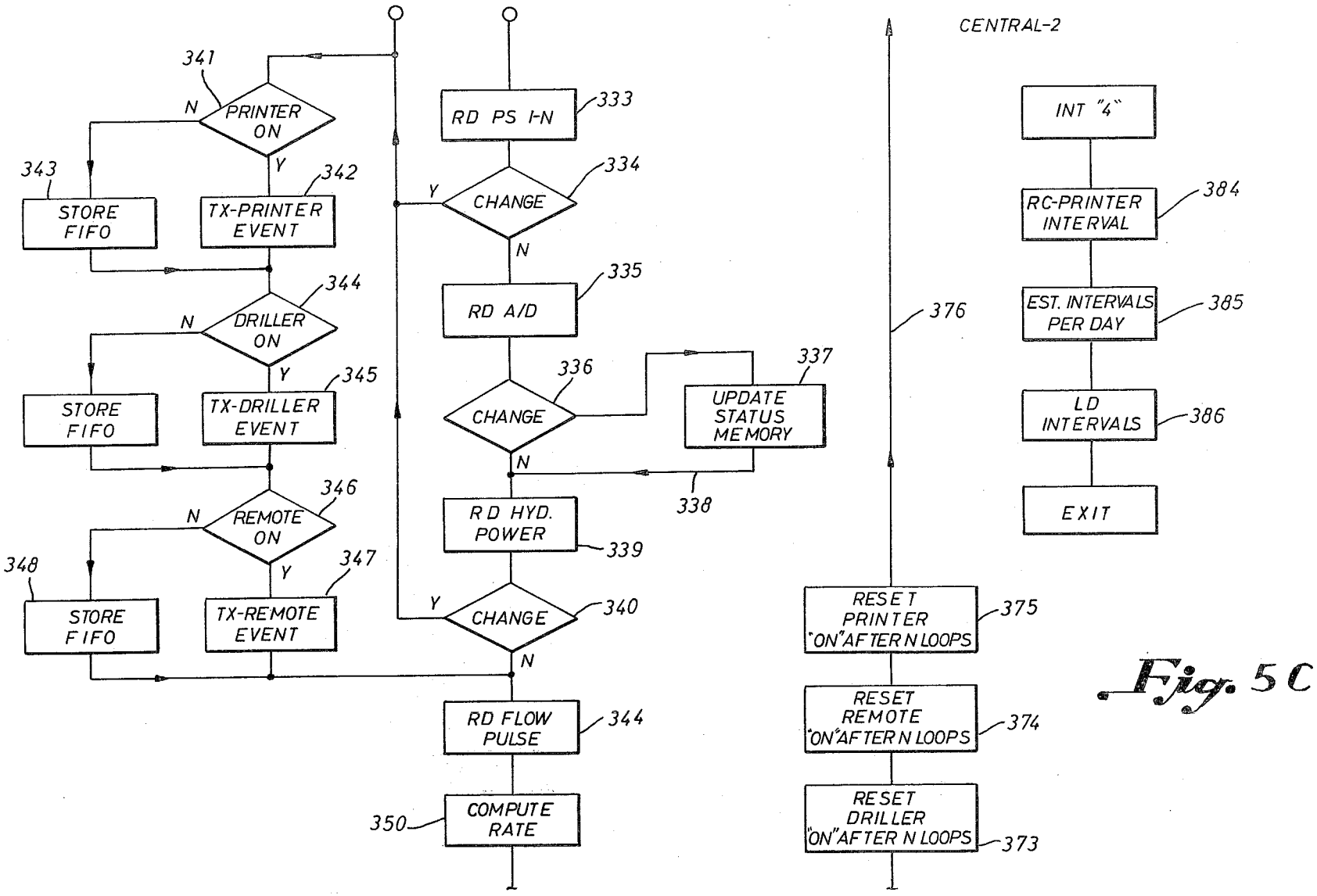
Figure 5D:
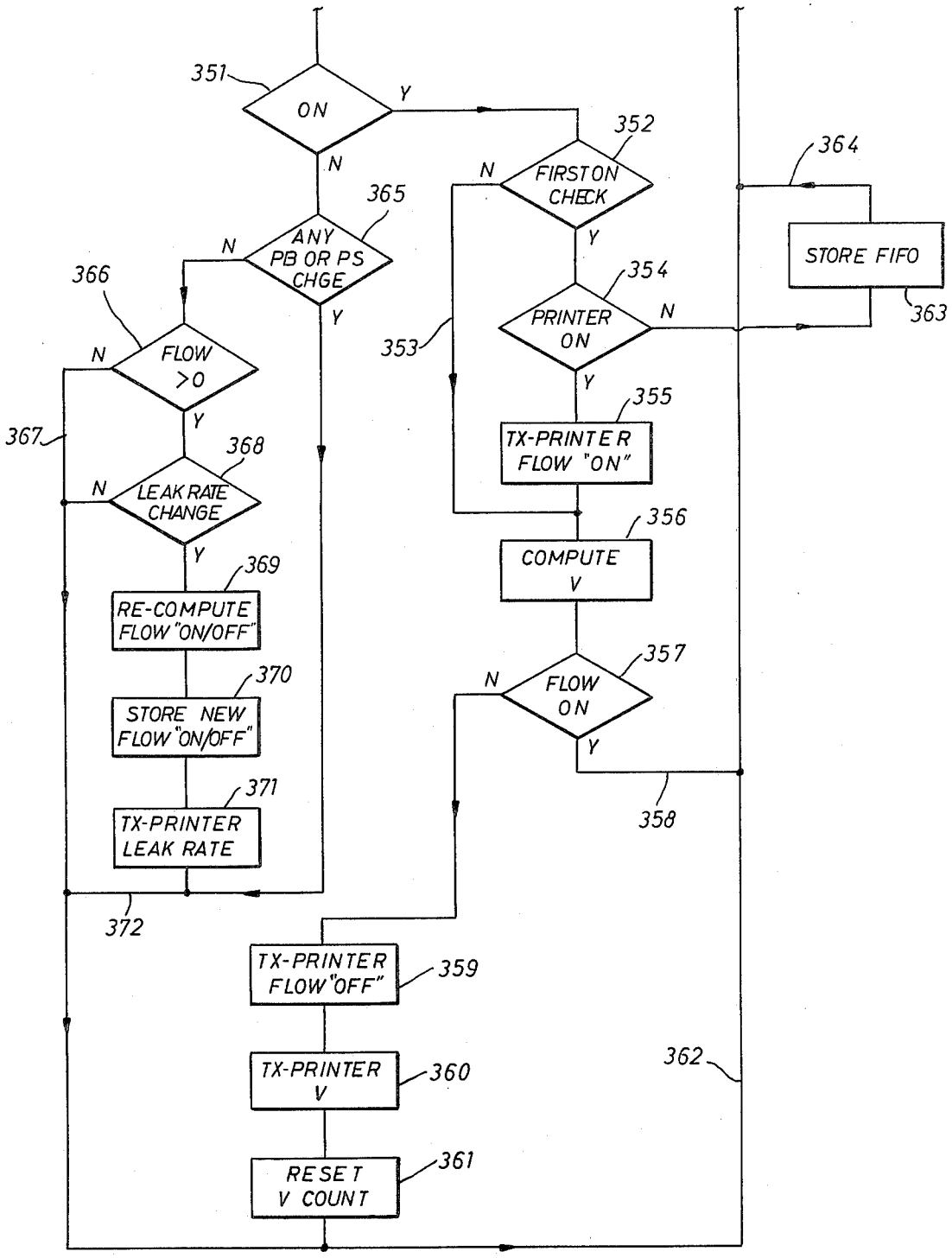

333, as seen in FIG. 5C, read PS1-N. After each event reading check to see if any change 334 has occurred since last loop. If none proceed on with loop. If a change has occurred, a. Store new status in ref. memory.

b. Proceed with "change" sequence. This is explained in 340 below.

335 Read all A/D inputs. After each event reading check to see if any change 336 has occurred. If none, proceed on with loop. If a change has occurred, 337 Store new status in ref. memory 338 Return to loop.

339 Read Hydraulic Power Status. Check to see if any change 340 has occurred. If none, proceed on with loop. If a change has occurred, Store new status in ref. memory Proceed with "change" sequence. This is explained in 340 below.

340 Change Sequence—In the event a change in status causes branching to change "sequence" the following secondary loop occurs.

341 The printer indicates in memory is check for "on". If on, the event and time are sent to the printer 342.

343 If off the event and time are stored in the FIFO and the secondary loop is continued.

344 The driller indicator in memory is checked for "on". If on, the event 345 if applicable is sent to the driller. If off the event is stored in the FIFO 346 and the secondary loop is continued.

346 The remote indicator in memory is checked for "on". If on, the event if applicable is sent to the remote 347.

348 If off the event is stored in the FIFO and the secondary loop returns to the main loop below the hydraulic power check and continues.

349 The flow is read.

350 The flow rate is computed.

351 The flow rate is compared with the initial "on" valve set in memory to determine if an "on" state exists. If "no" the loop continues in 365 below.

352 If "yes" the on is checked for a first time detected condition.

353 If it is the second or greater check a loop bypass is done.

354 If it is the first time detected the printer is checked for "on".

355 If "on" the event is sent to the printer.

356 The volume is computed since first on.

357 Flow is checked to see if it is still on.

358 If still on, a jump to the loop return is made.

359 If "off", the event is sent to the printer.

360 The final volume is sent to the printer.

361 The volume indicator is reset to zero.

362 Jump to the return loop is made.

363 If the printer is off the event is stored in the FIFO.

364 Jump to the return loop is made.

365 A check is made to see if any PB or PS has changed since the last loop. If yes a jump to the return loop is made.

366 If no PB or PS has not changed since the last loop, a check is made to see if flow is greater than zero.

367 If "no" a jump to the return loop is made.

368 If "yes" a check is made to see if the flow rate has changed. If no a jump to loop is made. If yes, 369 The "on/off" values are re-computed.

370 The new parameters are stored in memory.

371 The message "leak" and value is sent to the printer.

On each pass then the return loop.

373 The driller "on" status is reset after N loops.

374 The remote "on" status is reset after N loops.

375 The printer "on" status is reset after N loops.

376 The return loop re-enters above the check CTC for pulse change and the cycle is repeated.

At any time during the cycle the system can receive communications on an Interrupt basis. An interrupt stops the CPU, executes the interrupt subroutine and continues in cycle from the point of interruption. Some of the interrupts are, 377 (FIG. 5*a*) A change in PB status in either the driller or remote will immediately store the event in memory for cyclic detection.

378 A command from the printer will immediately stop the cycle, read time, all events and all analogs and send them to the printer 379.

380 A signal from the printer will after the Direct Memory Access (DMA) connection for faster communication regardless of where it is plugged in.

381 A receipt of actual time from the printer will cause the system to compute the time connection 382 (if any) for FIFO data and load the time in memory 383.

384 (FIG. 5C) receipt of an interval from the printer will cause the system to compute 385 and store in memory 386 the automatic report times/day.

Figure 6A:
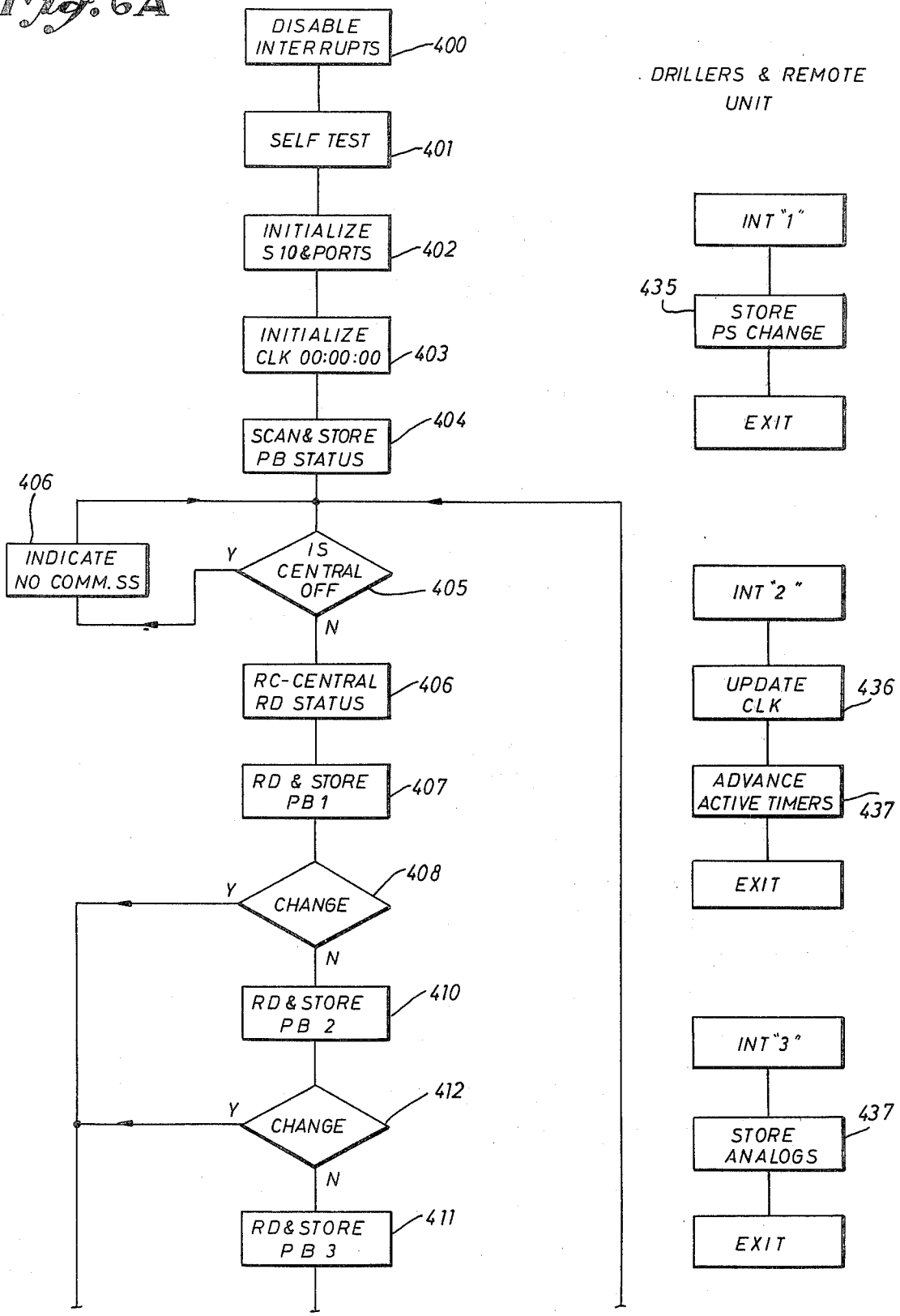
FIGS. 6A and 6B are a logic flow diagram of the driller and remote control unit.
Figure 6B:
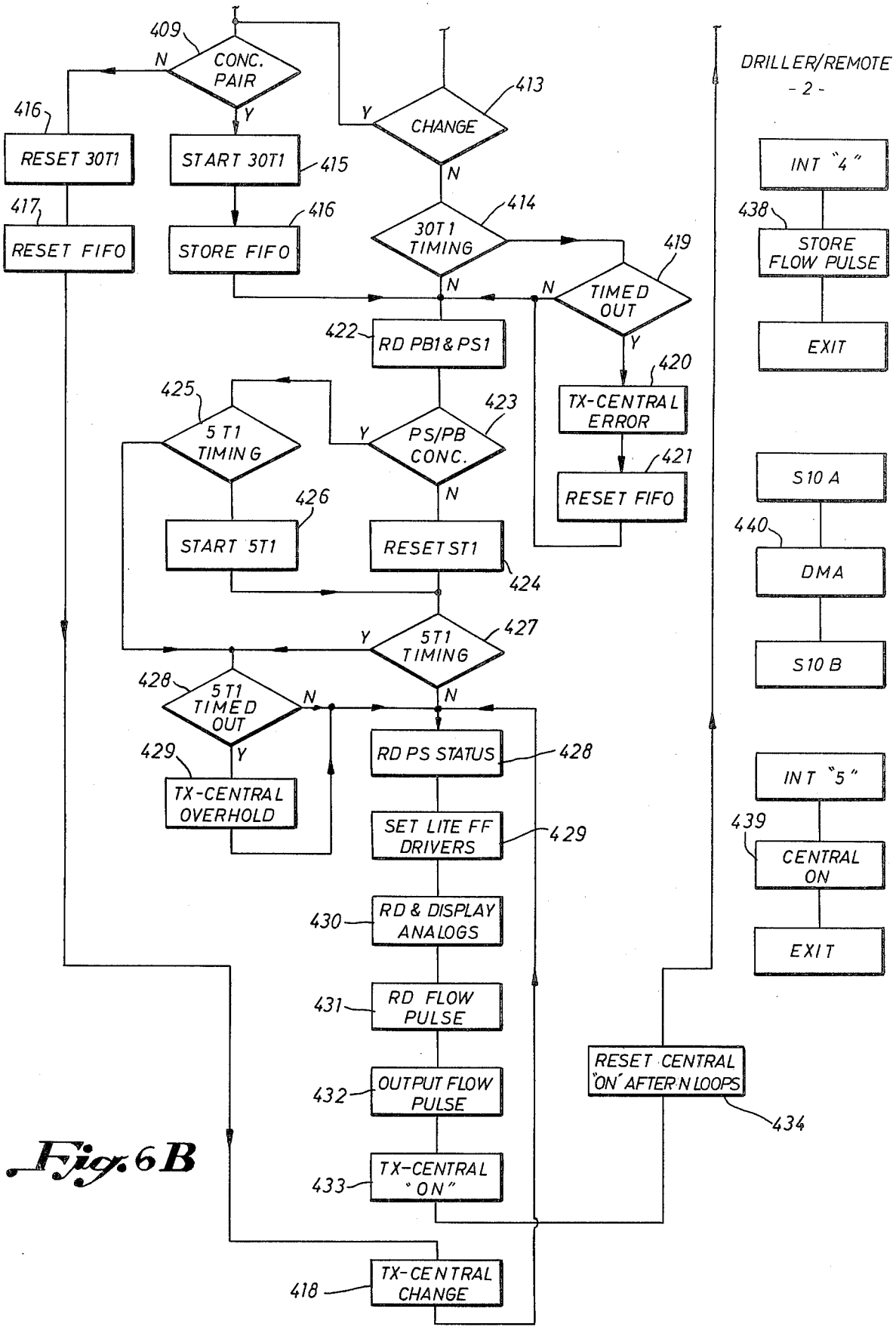

The Driller and Remote Units 16 and 22—FIGS. 6A and 6B

These units provide and maintain signals to all event indicator lights and monitors the status of all pushbuttons (PB). It sends and receives communications from Central unit 40 as well as providing a communication link for the printer 24 to central 40 if so configured. It maintains a real time clock slaved to central 40. This is accomplished by a loop scanning technique which is subject to interrupts from central 40. A typical startup and operation sequence would be as follows.

400 Disable Interrupts—this clears the interrupt structure preparatory to suitable initialization.

401 Self-Test—execute a CPU self-test routine to check for proper operation.

402 Initialize SIO and Ports—set up all SIO cards for the proper interrupt structure and priority. Set up the digital in ports and out ports as well as the analog D/A ports. Loads "off" in all ports.

403 Initialize system real time salve clock to 00:00:00.

404 Scan and stroke all PB status.

At this time the system is ready to enter the scan loop. It will remain in the loop unless interrupted for input of PS, clock, analog or flow pulse data or self-interrupt for output of PB or error change data. After interrupt, it returns to the loop. A cycle through the loop is as follows.

405 The memory is tested to see if central is on. If "yes" the loop proceeds. If "no" the unit turns on a "No Communications" light 406 and cycles back to test if central is "on". It will remain in this state until a valid on signal from central is received where on the "No Communications" light will turn off and the cycle will resume.

406 Read PS, analog and flow rate status from central and store in memory.

The following routines are executed in groups of three for three position controls (two for two position controls) and repeated in sequence until all groups have been tested.

407 Read & Store PBI—PBI is read and compared with what is in memory. The new status is stored in memory and any change of status 408 will cause branching of the loop to the concurrent pair test 409.

410 Read & Store PB2—same as for PB1.

411 Read & Store PB3—same as for PB1.

412 and 413 If no change is detected the loop checks to see if the timer 30Tl 414 has been started (this is in the concurrent contact closure timer for the first group). If it is not, the loop drops three. See 414 below.

409 In the event PB1, PB2 or PB3 shows a change all combinations (PB1-PB2, PB2-PB3 & PB1-PB3) are tested for concurrent closure (contacts stuck or double signals)

415 If concurrent closure is detected a thirty second timer (30Ti) is started and the event and time is stored in FIFO 416. Return to the loop is made below the test to see if 30Tl is running. If no concurrent closure is detected, the change loop branches to

416 Reset timer 30Tl if previously started.

417 Pick up data from and reset the FIFO in the event it has been used. This data or the original change signal (if the FIFO is empty) is shunted to the end of the loop.

418 Any change (with time) is sent to central and loop is re-entered above the scan and light set.

414 As stated in 412 and 413 above a "non change" status for the group will test the 30Tl timer to see if it is running.

419 If it is a branch is made and a test is made to see if it is still timing. If it is not, a return to the loop occurs.

420 If it has timed out a message is sent to central indicating concurrent contact closure which will be printed out on the printer. The FIFO will be reset 421.

422 After return to the loop from the concurrent contact closure tests or a straight through drop tests are run for concurrence between PB and respective PS.

423 PB1 and PS2 status are read from memory.

These signals are tested for concurrence and if none exists the path drops through to reset timer 5Tl 424 if it had been running.

425 If concurrent is detected timer 5Tl is started 426 and return to the loop is made. This is a 5 second timer.

427 A test is made to see if 5Tl is timing. If it isn't the path drops through to a similar test for PB2 and LS2. See below.

428 If it is timing a test is made to see if it has timed out. If it hasn't a return to loop is made.

429 If the timer 5Tl times out before the PB1/PS1 concurrent is cleared a signal is sent to central and the printer that a "over hold" or possibly a "stuck contact" event exists.

Step 422 is repeated for PB2/PS2 and PB3/PS3 pairs.

Steps 402 through 429 for all other groups of PB and LS is done.

428 Read all PS status from central.

429 Set all light FF drivers.

430 Read and display all analogs.

431 Read flow pulse from central.

432 Output flow pulse.

433 Output to central that remote/driller is "on". Enter return loop.

434 The status "central on" is reset after N loops.

The cycle is re-entered with the test to see if central is "on".

At any time during the cycle the system can receive communications on an interrupt basis. An interrupt stops the CPU, executes the interrupt sub-routine and continues in cycle from the point of interruption. Some of the interrupts are,

435 A change in PS status in central will immediately store the event in memory for cyclic detection.

436 A clock change (base pulse) will immediately advance the slave real time clock and advance the timers 437.

437 A change in analogs will immediately update the memory for cyclic adjustment of displays.

438 Flow pulse is immediately set in memory for cyclic processing.

439 Central "on" status is immediately stored in memory.

440 A signal from the printer will immediately alter the DMA connections for fastest communications regardless of where it is plugged in.

Figure 7:
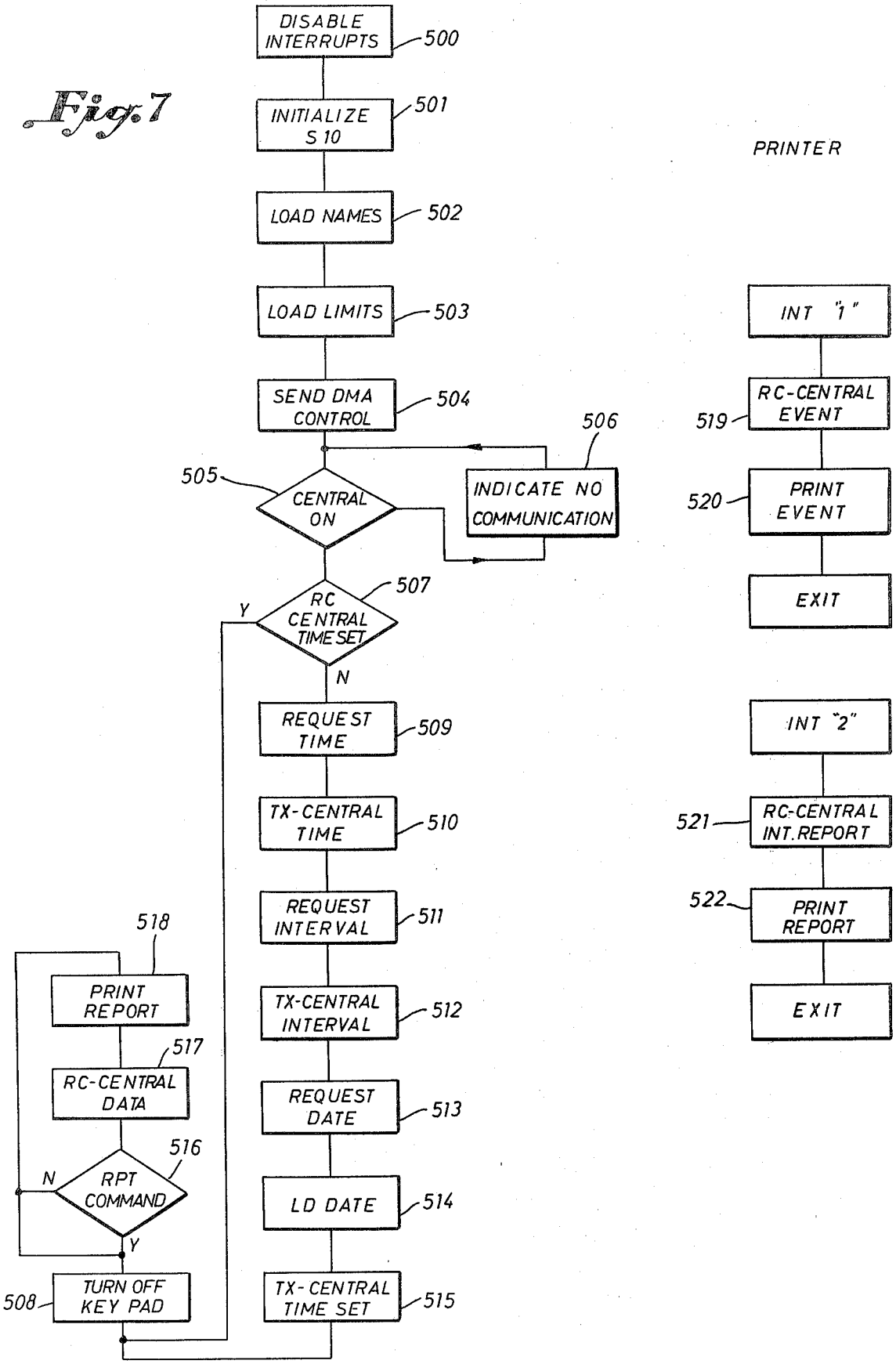
FIG. 7 is a logic flow diagram of the printer.

The Printer 24—FIG. 7

This unit is portable and can be plugged in at the remote 22, central 40 or drillers unit 16. It is the human/machine interface and is used to set in a. Real time. b. Interval. c. Date. It will receive and print any event change along with the time of accusence. Any error events will likeways be reported. At programmed intervals or on command a function status condition along with analog values will be printed. It contains the name and limit tables and uses them to make the output intelligible. Its startup and simple loop is as follows.

500 Disable Interrupts—this clears the interrupt structure preparatory to suitable initialization.

501 Initialize S10—set up S10 card for proper interrupt structure and priority.

502 Load Names—load function names from matrix on PC board.

503 Load Limits—load analog high/low limit from DIP switches on PC card.

504 SEND DMA CONTROL—output control to configure all DMA for best communication as a function of where printer is plugged in.

505 Central On—check to see if central is on. If "on" proceed. If off loop to indicate no communications 506 and cycle back for central on test. Remain in this test loop until central is "on".

507 Receive Central Time Set—check with central to see if time, interval and date has been previously set during this on period. If no, proceed with set up. If yes, loop to turn off key pad 508. Only one time set per on period is allowed.

509 Request Time—print out a request for the real time.

510 Send Central Time—as soon as the real time is input, it is sent to Central and likewise remote and drillers for setting the unit real time clock and slave clocks. Any material in FIFO's would be time corrected.

511 Request Interval—print out a request for the intervals per day for a circuit initiated status report.

512 Send Central Interval—as soon as the interval is input, it is sent to Central and the report time are computed and store in memory.

513 Request Date—print out a request for the date.

514 Load Data—the input data is stored in memory for use on page format headings. Only the real year will be accepted.

515 Send Central Time Set—sent central a marker that the time, interval and data have been set for this on period.

508 Turn off Key Pod—immobilize the key pad except for the report command input.

The small loop for the printer is now entered. It will stop in this loop unless commanded or interrupted.

516 Report Command—test to see if a report command is present. If yes, proceed on. If no, loop back and check for a report command.

517 Receiver Central data—receive all function status, analog data and flow data from central.

518 Print Report—format and print out the data collected in 517. Loop back check for a report command.

At any time during the cycle the system can receive communications on an Interrupt Basis. An interrupt stops the CPU, executes the interrupt sub-routine and continues in cycle from the point of interruption. Some of the interrupts are, 519 A signal from Central will cause an event to be printed out 520 as well as an error.

521 A signal from Central will cause a report to be printed out 522 of function status, analogs and flow data.

Once the entire system has been turned on and the Printer has initiated the clocks and intervals, it may be moved to any location any time without loss of data. It may be turned off for a reasonable time (depending on FIFO capacity).

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In combination with a blowout preventer control system for controlling the opening and closing of various preventers and measuring the status of various conditions in the system and having various control stations of a control system recorder comprising, position measuring means connected to various blowout preventers for measuring the position of the various blowout preventers, operating data gathering means connected to the blowout preventer system for measuring various operating conditions in the system, a recorder connected to the position measuring means and to the operating data gathering means, means for periodically actuating the recorder for periodically recording the position of the position measuring means and recording the measurement of the operating data gathering means, and means connected to the recorder for recording the position of the position measuring means and the measurement of the operating data gathering means each time the blowout preventer control system is actuated.

2. The apparatus of claim 1 including, fiber optic cables connected between the various control stations for transmitting data therebetween.

3. The apparatus of claim 1 including electronic sections at said control stations for sending and receiving electrical control and status information.

4. The apparatus of claim 1 wherein the recorder records the time when each record is made.

5. The apparatus of claim 1 wherein one of the control stations is positioned remote from the blowout preventer and includes, a processor and multiplex unit, a keyboard connected to the remote control station for manually actuating the processor.

6. The apparatus of claim 4 including, visual indicators connected to said remote unit indicating the position status of the blowout preventers.

7. The apparatus of claim 4 wherein the processor includes a memory for storing measured positions and gathered operating data and means for updating said memory and transmitting the changed information to the recorder.

* * * * *